US006496661B2

(12) United States Patent
Ando et al.

(10) Patent No.: US 6,496,661 B2
(45) Date of Patent: Dec. 17, 2002

(54) SHEET ATTACHMENT DETECTING APPARATUS, FIXING APPARATUS AND IMAGE FORMING APPARATUS

(75) Inventors: Masao Ando, Mishima (JP); Takayasu Yuminamochi, Shizuoka-ken (JP); Tomohiro Nakamori, Shizuoka-ken (JP); Yasunari Kobaru, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/774,587

(22) Filed: Feb. 1, 2001

(65) Prior Publication Data

US 2001/0028801 A1 Oct. 11, 2001

(30) Foreign Application Priority Data

Feb. 3, 2000 (JP) ..... 2000-025848

(51) Int. Cl.[7] ..... G03G 15/00; G03G 15/20
(52) U.S. Cl. ..... 399/22; 399/323
(58) Field of Search ..... 399/16, 18, 21, 399/22, 68, 322, 323, 398

(56) References Cited

U.S. PATENT DOCUMENTS 3,650,616 A * 3/1972 Hudson ..... 399/22
3,650,619 A * 3/1972 Parker ..... 399/22
4,073,585 A * 2/1978 Kobayashi et al. ..... 399/22
4,239,372 A * 12/1980 Iwai ..... 399/22
4,512,649 A * 4/1985 Derimiggio ..... 399/22
5,386,983 A 2/1995 Ando ..... 271/118
5,404,200 A * 4/1995 Martin et al. ..... 399/68
5,406,354 A * 4/1995 Taki et al. ..... 399/22
5,455,659 A 10/1995 Ishizu et al.
5,612,776 A 3/1997 Machino et al. ..... 399/43
6,005,594 A 12/1999 Nanataki et al. ..... 347/156

FOREIGN PATENT DOCUMENTS

JP 11-038817 * 2/1999
JP 2000-255835 * 9/2000

* cited by examiner

*Primary Examiner*—Sandra Brase
(74) *Attorney, Agent, or Firm*—Fitzpatrick, Cella, Harper & Scinto

(57) ABSTRACT

A sheet attachment detecting apparatus includes a rotary member which is rotatable for conveying a sheet and whose surface is electrically conductive, an electrically conductive member which can be abutted on and separated from the surface of the rotary member, and an attachment detector which applies a power to the rotary member and the electrically conductive member for detecting the attachment of the sheet around the rotary member.

12 Claims, 6 Drawing Sheets

SHEET ATTACHMENT DETECTING APPARATUS, FIXING APPARATUS AND IMAGE FORMING APPARATUS

BACKGROUND OF THE INVENTION

1. Field of the Invention

The present invention relates to a sheet attachment detecting apparatus that is capable of detecting a phenomenon that a sheet is attached around a rotary member that conveys the sheet when the phenomenon occurs, and a fixing apparatus and an image forming apparatus each having the sheet attachment detecting apparatus.

2. Related Background Art

At present, many image forming apparatuses such as printers or copying machines are electrophotographic systems. In this system, a toner image formed on the photosensitive drum is transferred onto a sheet conveyed at a transfer position to form an image. However, because the toner image is unstable after the toner image is transferred onto the sheet, the sheet is conveyed to a fixing apparatus where the toner image is fixed onto the sheet.

The fixing apparatus which is made up of a pair of rollers consisting of a fixing roller having a heater therein and a pressure roller that presses the sheet under a predetermined pressure to the fixing roller is widely employed because it is simple in structure.

That is, while the sheet is nipped between and conveyed by both of the rollers that are rotating, heat and pressure are applied to the sheet, to thereby permit the toner image to be permanently fixed around the sheet.

However, there is a case in which the sheet is attached onto the surface of the rollers while the sheet is nipped and conveyed by the pair of rollers. Up to now, even if the sheet is attached around the fixing roller or the pressure roller, there was provided no means for detecting that fact directly.

For that reason, when a power supply of the apparatus turns on and off in a state where the sheet is attached around the roller, the roller is driven and rotated, and the sheet is further attached around the roller, as a result of which there may occur severe sheet jamming.

This phenomenon is not limited to the rollers in the fixing apparatus, but may occur in any roller in the case where the sheet is conveyed by the rollers.

SUMMARY OF THE INVENTION

The present invention has been made to solve the above problem, and therefore an object of the present invention is to provide a sheet attachment detecting apparatus that is capable of detecting a phenomenon that a sheet is attached around (wound round) a rotary member that rotates to convey the sheet when the phenomenon occurs, and a fixing apparatus and an image forming apparatus each having the sheet attachment detecting apparatus.

In order to achieve the above object, according to the present invention, there is provided a representative structure comprising: a rotary member which is rotatable for conveying a sheet and whose surface is electrically conductive; an electrically conductive member which can be abutted on and separated from the surface of the rotary member; and an attachment detecting means which applies a power to the rotary member and the electrically conductive member for detecting the attachment of the sheet around the rotary member.

In the above structure, when the sheet is attached around the rotary member, the sheet exists between the electrically conductive member and the rotary member. As a result, a potential difference is different between a case where a sheet does not exist between the electrically conductive member and the rotary member and a case where a sheet exists therebetween when the power is applied to the electrically conductive member. Accordingly, the attachment of the sheet around the rotary member is detected by detecting a voltage across the electrically conductive member.

Because the present invention is structured as described above, the attachment of the sheet around the rotary member can be detected. For that reason, the severe jamming can be prevented in advance by stopping the drive of the apparatus or the like at the time when the attachment of the sheet around the rotary member is detected.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Now, a description will be given in more detail of an image forming apparatus in accordance with preferred embodiments of the present invention with reference to the accompanying drawings.

FIRST EMBODIMENT

Figure 1:
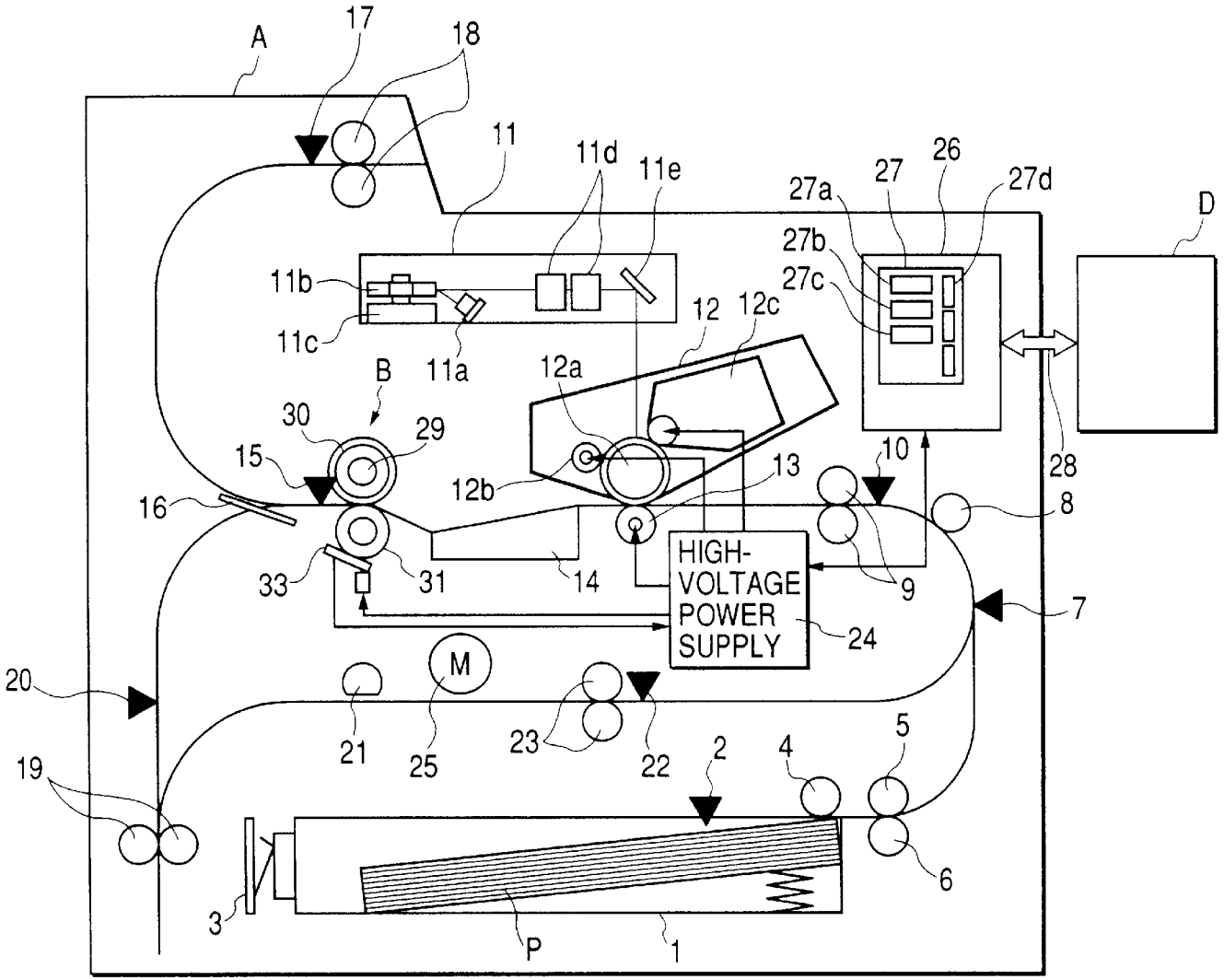
FIG. 1 is a structurally explanatory diagram showing a laser beam printer in accordance with an embodiment of the present invention.
Figure 2:
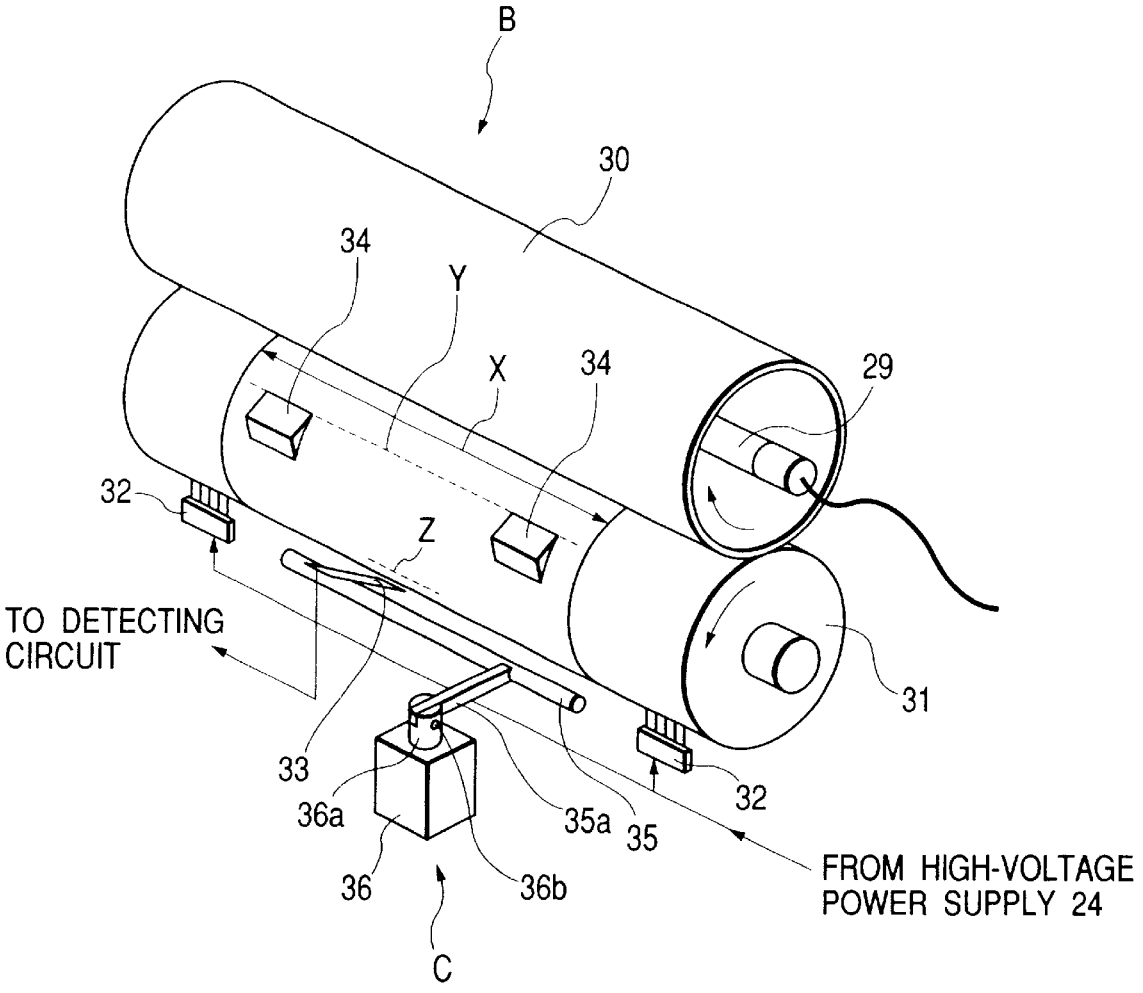
FIG. 2 is a perspective explanatory diagram showing a sheet attachment detecting means in a fixing means.
Figure 3A:
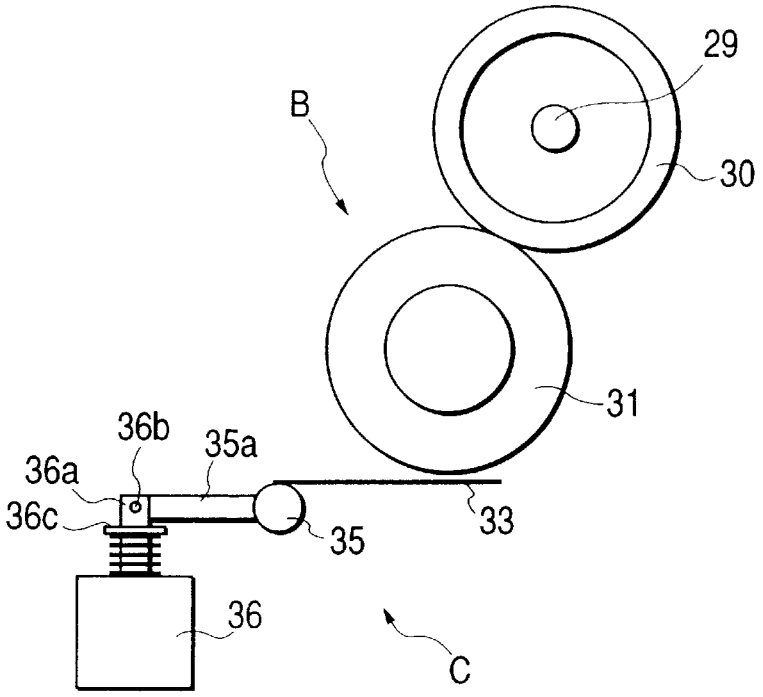
FIGS. 3A and 3B are explanatory diagrams showing a detection state and an undetection state of the sheet attachment detecting means.
Figure 3B:
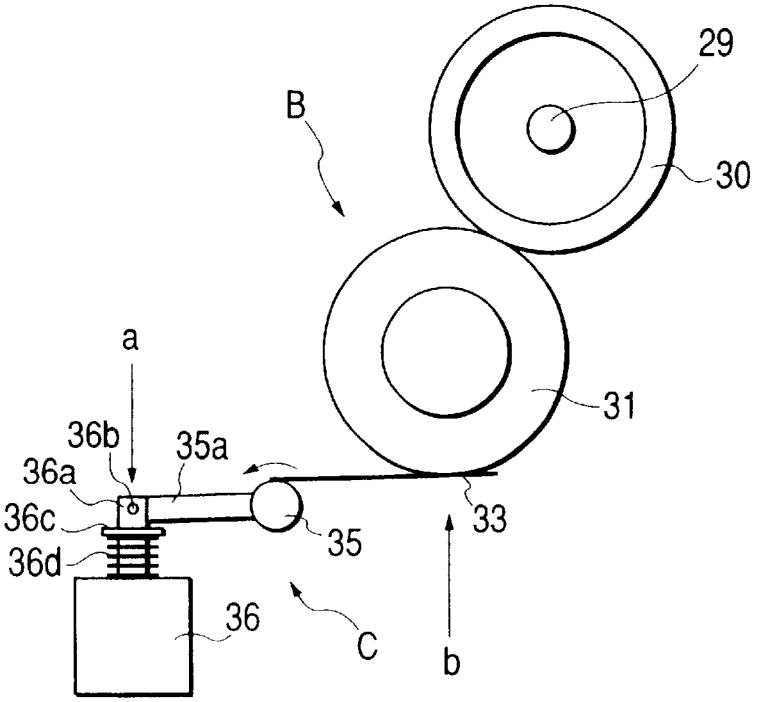
Figure 4:
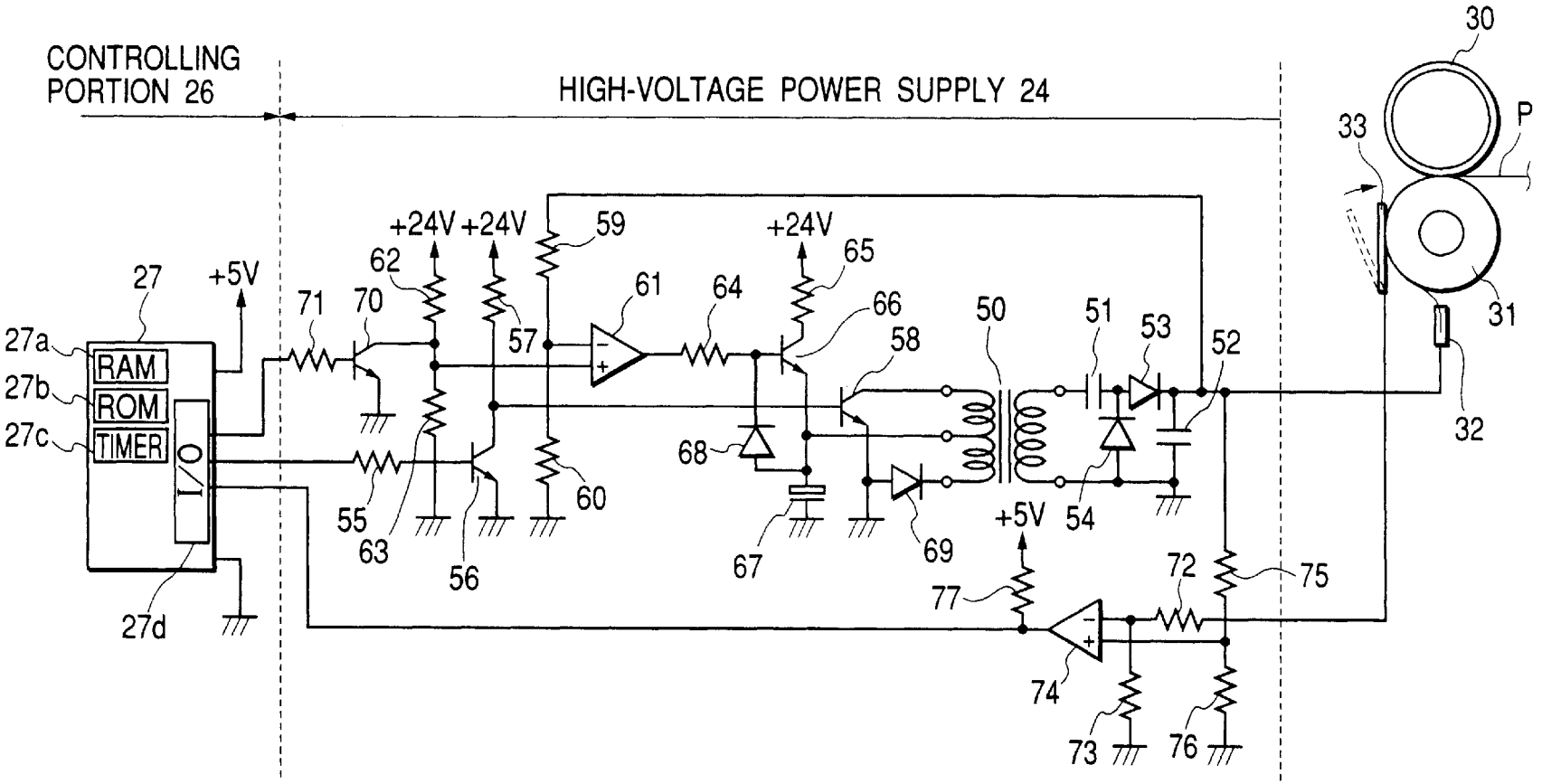
FIG. 4 is an explanatory diagram showing a sheet attachment detecting circuit.
Figure 5:
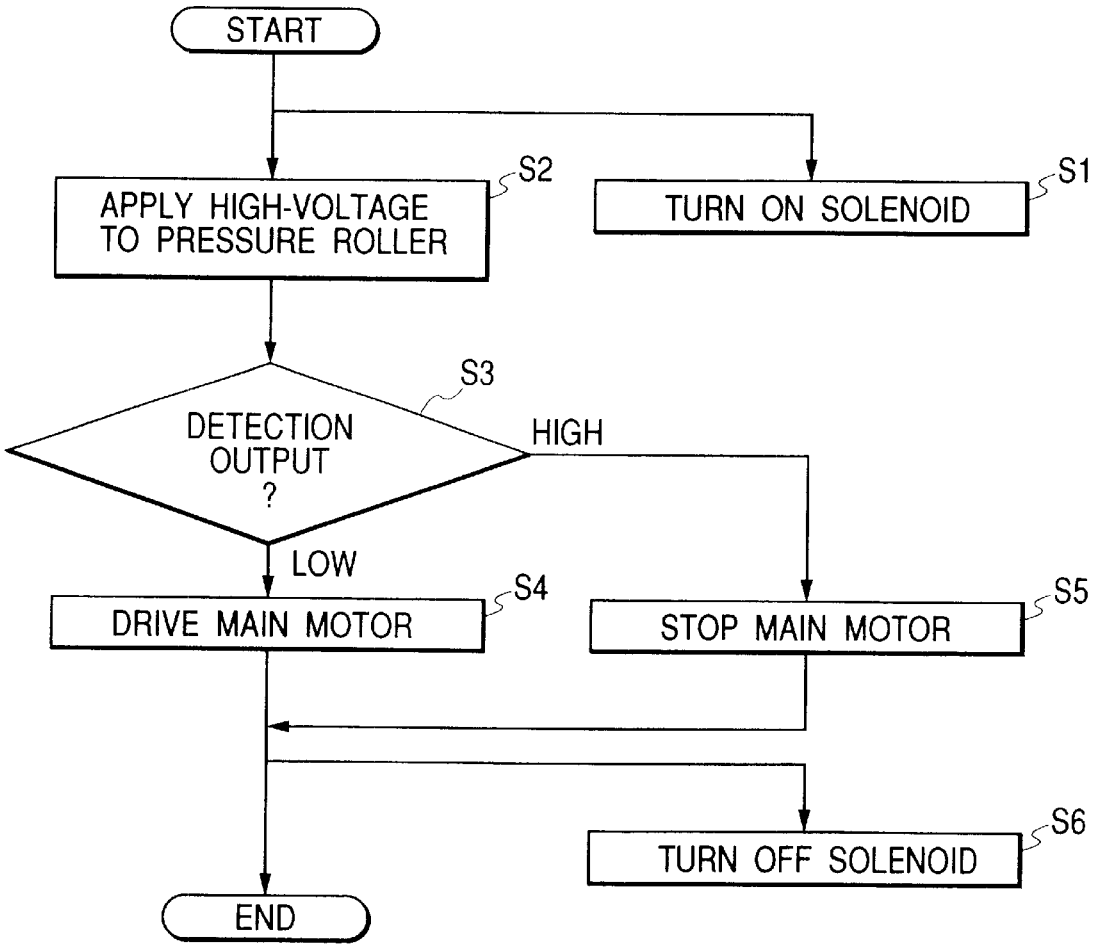
FIG. 5 is a flowchart showing a sheet attachment detecting procedure.

A first embodiment will be described with reference to FIGS. 1 to 5. FIG. 1 is a structurally explanatory diagram showing a laser beam printer in accordance with an embodiment of the present invention. FIG. 2 is a perspective explanatory diagram showing a sheet attachment detecting means in a fixing means. FIGS. 3A and 3B are explanatory diagrams showing a detection state and an undetection state of the sheet attachment detecting means. FIG. 4 is an explanatory diagram showing a sheet attachment detecting circuit. FIG. 5 is a flowchart showing a sheet attachment detecting procedure.

ENTIRE STRUCTURE

First, the entire structure of an image forming apparatus A will be described with reference to FIG. 1.

The image forming apparatus according to this embodiment is directed to a laser printer of the electrophotographic type. This image forming apparatus includes a deck 1 that contains a recording sheet P therein, a deck sheet presence/absence sensor 2 for detecting the presence/absence of the recording sheet P within the deck 1, a sheet size detecting sensor 3 for detecting the size of the recording sheet P within the deck 1, a pickup roller 4 for picking up a recording sheet P from the deck 1, a deck feed roller 5 for conveying the recording sheet P picked up by the pickup roller 4, and a retard roller 6 paired with the deck feed roller 5 for preventing the double feed of the recording sheet P.

Then, downstream of the sheet conveying direction of the deck feed roller 5 (hereinafter referred to simply as downstream), there are provided the deck 1, a feed sensor 7 for detecting the feed/conveyance state of the sheet from a two-side reversing portion which will be described later, a sheet feed/conveyance roller 8 for conveying the recording sheet P further downstream, a pair of registration rollers 9 that convey the recording sheet P in synchronism with the image forming operation, and an ante-registration sensor 10 for detecting the conveying state of the recording sheet P to the pair of registration rollers 9.

Also, downstream of the pair of registration rollers, a process cartridge 12 that constitutes an image forming means for forming a toner image on the photosensitive drum on the basis of a laser beam from a laser scanner portion 11 which will be described later is detachably mounted on the apparatus body. The process cartridge 12 includes a rotatable photosensitive drum 12*a*, a charging roller 12*b* and a developing device 12*c* each being disposed around the photosensitive drum 12*a*, and also a cleaning unit not shown. In formation of the image, the surface of the photosensitive drum 12*a* is uniformly charged by the charging roller 12*b*, and exposure is selectively conducted by the laser scanner portion 11 to form a latent image, and the latent image is developed with toner by a developing device 12*c* so as to be visualized. Then, the toner image is transferred onto the conveyed recording sheet P by applying a transfer bias voltage to the transfer roller 13 to form an image.

In addition, downstream of the transfer roller 13, there is disposed a fixing apparatus B that thermally fixes the toner image transferred onto the recording sheet P. The fixing apparatus has a sheet attachment detecting apparatus, and its structure will be described later.

Then, a fixing discharge sensor 15 for detecting the conveying state from the fixing apparatus B and a duplex-flapper 16 for changing over a path to which the recording sheet P is conveyed from the fixing apparatus B to a discharge portion or a two-side reversing portion. Downstream of the discharge portion side, there are disposed a discharge sensor 17 for detecting the sheet conveying state of the discharge portion, and a pair of discharge rollers 18 for discharging the recording sheet.

On the other hand, in order to record two sides of the recording sheet P, after single-sided recording has been completed, the front side and back side of the recording sheet P are reversed, and on the two-side reversing portion side for feeding the sheet to the image forming portion again, there are disposed a pair of reverse rollers 19 for switching back the recording sheet P by forward and reverse rotations, a reverse sensor 20 for detecting the sheet conveying state to the pair of reverse rollers 19, a D-cut roller 21 for conveying the recording sheet P from a lateral registration portion (not shown) for registering the lateral position of the recording sheet P, a duplex sensor 22 for detecting the conveying state of the recording sheet P of the two-side reversing portion, and a duplex conveying roller pair 23 for conveying the recording sheet P from the two-side reversing portion to the feed portion.

Also, the laser scanner portion 11 is made up of a laser unit 11*a* for emitting a laser beam modulated on the basis of an image signal sent out from an external device D which will be described later, and a polygon mirror 11*b*, a scanner motor 11*c*, an imaging lens group 11*d* and a return mirror 11*e*, for scanning a laser beam from the laser unit 11*a* on the photosensitive drum 12*a*.

Also, reference numeral 24 denotes a high-voltage power supply which includes, in addition to a pressure roller high-voltage circuit which will be described later, a high voltage circuit for applying a desired high voltage to the charging roller 12*b*, the developing device 12*c*, and the transfer roller 13. Also, reference numeral 25 denotes a main motor which applies powers to the respective portions.

In addition, reference numeral 26 denotes a printer controlling portion for controlling the image forming apparatus A which is made up of an MPU (microcomputer) 27 equipped with a RAM 27*a*, a ROM 27*b*, a timer 27*c*, a digital input/output port (hereinafter referred to as "I/O port") 27*d* and so on, and various input/output control circuits (not shown), or the like.

The printer controlling portion 26 is connected to the external device D such as a personal computer through an interface 28.

FIXING APPARATUS AND SHEET ATTACHMENT DETECTING APPARATUS

Subsequently, a description will be given of the structures of the fixing apparatus B and the sheet attachment detecting apparatus C used in the above image forming apparatus.

The fixing apparatus B is so designed as to thermally fix the toner image transferred onto the recording sheet P, and is made up of a rotatable roller pair consisting of a fixing roller 30 having therein a halogen heater 29 for heating, and a pressure roller 31 as a rotary member a surface of which is electrically conductive. Then, while the recording sheet P onto which the toner image has been transferred is nipped and conveyed by the roller pair, a heat and a pressure are applied to the sheet to permanently fix the toner image onto the sheet.

Then, in the pressure roller 31 which is one rotary member of the fixing apparatus, there is disposed a sheet attachment detecting apparatus C for detecting the attachment of the sheet when the recording sheet P is attached around the roller 31. As shown in FIG. 2, the detecting apparatus C is made up of a conductive brush 32 for applying a high voltage to the surface of the pressure roller 31, an attachment sensor 33 formed of an electrically conductive member for detecting the attachment of the recording sheet P around the pressure roller 31, and detecting means for detecting whether a potential difference between the attachment sensor 33 and the conductive brush 32, that is a voltage across the attachment sensor 33 is larger than a reference value, or not.

The attachment sensor 33 is so disposed as to abut against the pressure roller 31 in a sheet passing portion X of the pressure roller 31 downstream, in the pressure roller rotating direction, of separation claws 34 serving as a separating means for separating the recording sheet P from the pressure roller 31. In other words, even if the recording sheet nipped and conveyed by the fixing roller 30 and the pressure roller 31 is attached on the pressure roller 31, the recording sheet is separated and discharged from the surface of the roller 31 by the separation claws 34. The sheet remained attached around the pressure roller 31 without being separated by the separation claws 34 because a force of attaching the recording sheet around the pressure roller 31 is high and the sheet is detected by the attachment sensor 33.

Also, an abutment position Z of the attachment sensor 33 for the pressure roller 31 is opposite to a nip portion of the fixing roller 30 and the pressure roller 31. That is, in FIG. 2, an upper portion of the pressure roller 31 nips the recording sheet in association with the fixing roller 30, and the attachment sensor 33 is so disposed as to abut against a lower portion of the pressure roller 31. As a result, even if a foreign material such as paper dust drops down from the sheet which is conveyed through the nip portion, the paper dust or the like becomes difficult to attach to the abutment portion Z of the pressure roller 31 and the attachment sensor 33.

The attachment sensor 33 is formed of an elastic member which is electrically conductive and flexible and is fixed to an insulating support shaft 35 which is in parallel with the pressure roller 31 and rotatable. In other words, the attachment sensor 33 is disposed so as to be orthogonal to the rotating shaft of the pressure roller 31. One end of the support shaft 35 is formed with an arm portion 35*a*, and a distal end of the arm portion 35*a* is swingably supported by a fulcrum 36*b* of a plunger 36*a* of a solenoid 36.

FIG. 3A shows a state in which the solenoid 36 is de-energized, and a ring 36*c* is engaged with the plunger 36*a* of the solenoid 36, and the solenoid is urged upward by a compression spring 36*d*. Then, when a current flows in the solenoid 36, as shown in FIG. 3B, the plunger 36*a* is sucked and moved against the compression spring 36*d* in a direction indicated by an arrow "a" in FIG. 3B.

With the above action, the support shaft 35 rotates in a counterclockwise direction. Therefore, the attachment sensor 33 fixed onto the support shaft 35 rotates in a direction indicated by an arrow "b" in FIG. 3B and then abuts against the surface of the pressure roller 31 in a predetermined force. In this embodiment, the abutment force of the attachment sensor 33 against the pressure roller 31 is set to be 0 mN (0 gf) to 980 mN (100 gf). When the abutment force is thus made smaller, a change in the potential difference becomes large between a case where the sheet exists between the attachment sensor 33 and the pressure roller 31 and a case where no sheet exists therebetween, thereby being capable of preventing an error of the sheet attachment detection.

Subsequently, the structure of a detecting circuit as the sheet attachment detecting means according to this embodiment will be described with reference to FIG. 4. Referring to FIG. 4, reference numeral 50 denotes an inverter transformer, and an output voltage created at a secondary winding of the inverter transformer 50 is rectified by a doubler voltage rectifying circuit made up of high pressure capacitors 51, 52 and high pressure diodes 53 and 54, and thereafter applied to the conductive brush 32.

Also, a primary winding side of the inverter transformer 50 turns on/off a clock signal outputted from an I/O port 27*d* of the MPU 27 through a base resistor 55, a small-signal transistor 56, a pull-up resistor 57 connected to the collector side of the small-signal transistor 56 and a transistor 58. Also, in order to control the output voltage, a voltage resulting from dividing the output voltage by resistors 59 and 60 is inputted to a minus terminal of an operational amplifier 61, and a reference voltage resulting from dividing a power supply voltage +24 V by resistors 62 and 63 is inputted to a plus terminal of the operational amplifier 61. An output of the operational amplifier is adjusted to an input voltage of the inverter transformer through a transformer driver circuit made up of resistors 64, 65, a transistor 66 and an aluminum electric field capacitor 67.

In this example, the diode 68 is a protective diode of the transistor 66, and a diode 69 is so designed as to flow a flyback current into an inverter transformer. In addition, the plus terminal of the operational amplifier 61 is grounded through a transistor 70 and a resistor 71 by a signal from the I/O port 27*d* of the MPU 27, thereby being capable of making the reference voltage 0 V and the high voltage output turn off.

On the other hand, the voltage across the attachment sensor 33 is divided by resistors 72 and 73, and is then inputted to a minus terminal of a comparator 74, and the high-voltage output voltage is divided by resistors 75 and 76, and is then inputted to a plus terminal of the comparator 74. Those respective resistances are set in such a manner that the plus terminal voltage of the comparator 74 becomes larger than the voltage at the minus terminal if the voltage across the attachment sensor 33 is equal to or less than 85% of the high-voltage output voltage, and the output of the comparator 74 becomes high through a pull-up resistor 77. An output of the comparator 74 is connected to an input terminal of the I/O port 27*d* of the MPU 27.

In the above circuit, in the case where no recording sheet is attached around the pressure roller 31, the voltage across the sensor 33 is not lowered much because the attachment sensor 33 is in direct contact with the surface of the pressure roller 31. Therefore, in this case, the comparator 74 outputs a low output. On the other hand, in a state where the recording sheet P is attached around the pressure roller 31, because the recording sheet P exists between the pressure sensor 31 and the attachment sensor 33, the voltage across the attachment sensor 33 is lowered as compared with a case where no recording sheet exists therebetween, as a result of which the comparator 74 outputs a high signal. With the above operation, a fact that the recording sheet is nipped between the pressure roller 31 and the attachment sensor 33 can be detected by the MPU 27.

The image forming apparatus according to this embodiment operates as shown in FIG. 5 in accordance with the detection result by the above detecting circuit. That is, when a power supply is supplied to the apparatus body, the solenoid 36 first turns on, and the attachment sensor 33 abuts against the pressure roller 31 (S1). Then, a voltage is applied to the pressure roller 31 through the conductive brush 32 (S2), and the detection result in the detecting circuit is checked out as described above (S3).

Then, if the detection result is low, because the sheet is not attached around the pressure roller 31, the main motor 25 is driven to conduct a predetermined printing (S4), and the solenoid 36 is turned off (S6). On the other hand, if the detection result is high, because the sheet is attached around the pressure roller 31, the main motor 25 is stopped (S5), and thereafter the solenoid 36 is turned off (S6). As a result, if the sheet is attached around the pressure roller 31, the apparatus automatically stops, and the severe jamming is prevented from occurring without the fixing apparatus being driven while the sheet is attached around the roller.

As described above, according to this embodiment, even if the power supply of the image forming apparatus is turned on and off in a state where the sheet is attached onto the pressure roller 31, the attachment (winding) of the recording sheet around the pressure roller 31 can be prevented.

Also, even if a foreign material (paper dust and toner) from the conveyed recording sheet drops down, because the foreign material is shielded by the pressure roller 31, the foreign material is not deposited on the abutment portion of the attachment sensor 33 and the surface of the pressure roller, thereby being capable of preventing contact failure. Also, because the attachment sensor 33 is not always abutted against the pressure roller 31, the surface of the pressure roller can be prevented from being damaged. Also, because the attachment sensor 33 is so disposed as to be orthogonal to the rotating shaft of the pressure roller 31, when the recording sheet attached around the surface of the pressure roller is removed or when the recording sheet is attached around the pressure roller, even if the attachment sensor 33 is abutted against the surface of the pressure roller due to control trouble, the attachment sensor 33 is merely elastically deformed, thereby being capable of preventing destruction, or the like.

SECOND EMBODIMENT

Figure 6:
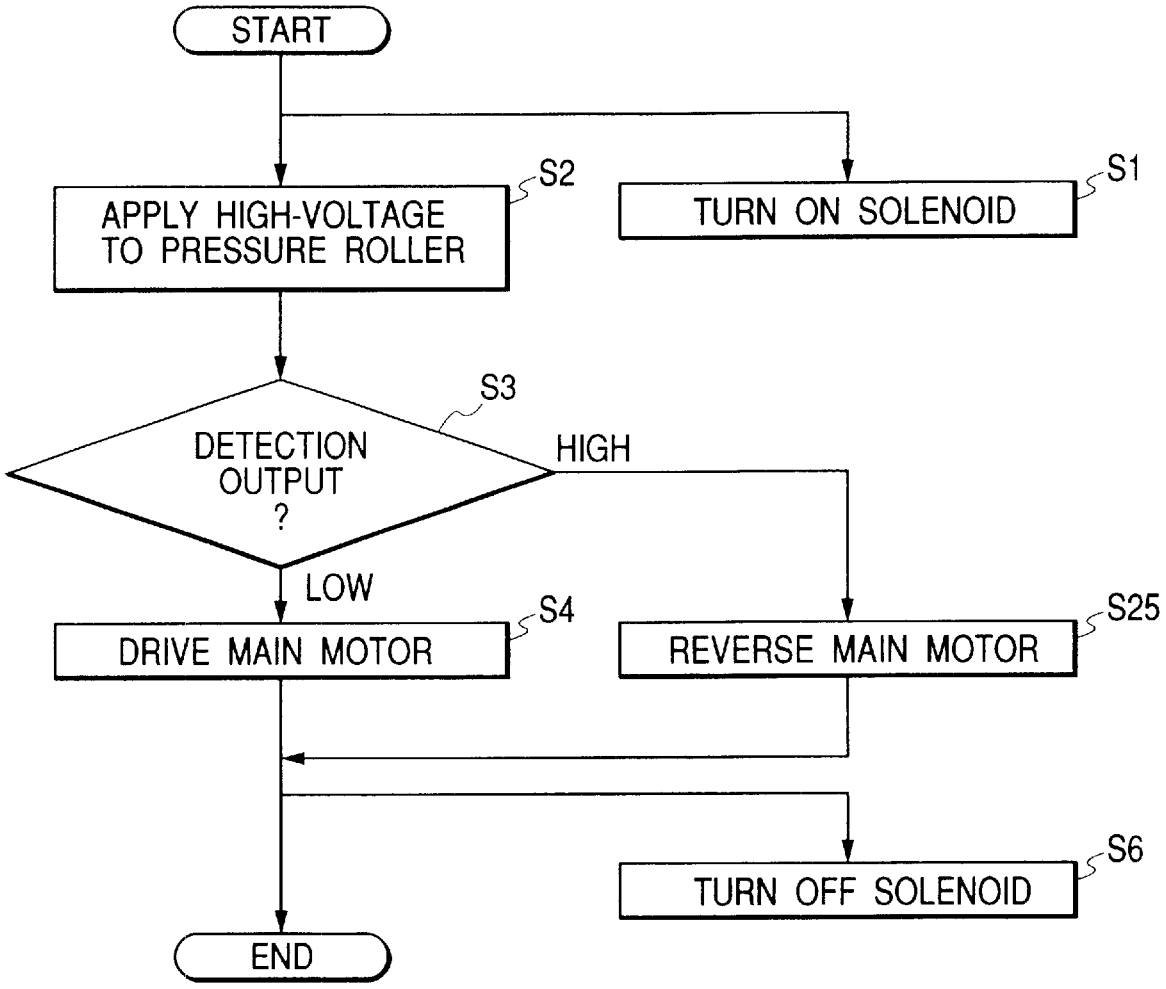
FIG. 6 is a flowchart showing an attachment preventing means in accordance with a second embodiment of the present invention.

In the above-mentioned first embodiment, in the case where the recording sheet is attached around the pressure roller 31, the apparatus stops driving. However, the drive control may be conducted as shown in FIG. 6. FIG. 6 is a flowchart showing an attachment preventing procedure in accordance with the second embodiment.

The operational procedure shown in FIG. 6 is different from that of the first embodiment in the operation of Step S5 in FIG. 5, but identical with that of the first embodiment in other steps. In other words, in this embodiment, if it is judged that the recording sheet is attached around the pressure roller 31 by the detecting circuit (the output of the comparator 74 is high), the driving of the apparatus does not stop, but the main motor is reverse-driven for a predetermined period of time as shown in Step S25 of FIG. 6.

As a result, because the pressure roller 31 rotates in a reverse direction opposite to a normal conveying direction, the recording sheet attached around the roller 31 can be readily removed.

THIRD EMBODIMENT

In the above-mentioned embodiment, the structure in which the roller around which the sheet is attached is detected is exemplified by the pressure roller 31. However, the structure is so modified as to detect the attachment of the sheet on the fixing roller 30, or to detect the attachment of the sheet around both of the fixing roller 30 and the pressure roller 31.

Further, the sheet attachment detecting mechanism does not need to be limited to the roller of the fixing apparatus. But, the attachment of the sheet around the roller can be detected by the provision of the detecting circuit if the roller conveys the sheet, and if the operation of the apparatus is controlled in accordance with the detection result, the severe jamming can be prevented in advance.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet attachment detecting apparatus, comprising:

a first rotary member which is rotatable for conveying a sheet and whose surface is electrically conductive;

a second rotary member for nipping and conveying the sheet in cooperation with said first rotary member;

an electrically conductive member which can be abutted on and separated from a surface of said first rotary member; and attachment detecting means which applies an electric power to said first rotary member and said electrically conductive member for detecting an attachment of the sheet around said first rotary member.

2. A sheet attachment detecting apparatus according to claim 1, wherein said attachment detecting means detects the attachment of the sheet around the first rotary member by detecting a voltage across of said electrically conductive member.

3. A sheet attachment detecting apparatus according to claim 2, wherein an abutment force of said electrically conductive member when abutting against said first rotary member is set to 980 mN (100 gf) or less.

4. A sheet attachment detecting apparatus according to claim 2, wherein said electrically conductive member comprises an elastic member having flexibility in a direction that crosses a rotational axis of said first rotary member.

5. A sheet attachment detecting apparatus according to claim 4, wherein said electrically conductive member abuts against said first rotary member at a position where a foreign material from the sheet conveyed by said first rotary member does not drop down.

6. A sheet attachment detecting apparatus according to claim 4, wherein said electrically conductive member abuts against said first rotary member downstream, in a rotating direction of said first rotary member, of separating means for separating the sheet from said first rotary member.

7. A fixing apparatus for fixing an image formed on a sheet, comprising:

a sheet attachment detecting apparatus for detecting that the sheet is attached around said first rotary member according to any one of claims 1 to 6, wherein said second rotary member and said first rotary member are fixing members.

8. A fixing apparatus according to claim 7, wherein when the attachment of the sheet around said first rotary member is detected, a driving of said first rotary member stops.

9. A fixing apparatus according to claim 7, wherein when the attachment of the sheet around said first rotary member is detected, said first rotary member is reversely driven.

10. A fixing apparatus according to claim 7, wherein one of said second rotary member and said first rotary member is a fixing roller for applying a heat to the sheet, and the other one is a pressure roller for pressing the sheet against said fixing roller.

11. An image forming apparatus in which a sheet is conveyed, an image is formed on the sheet, and the sheet is conveyed to a fixing apparatus to fix the image onto the sheet, wherein said fixing apparatus comprises a fixing apparatus according to claim 7.

12. An image forming apparatus according to claim 11, wherein said electrically conductive member abuts against said first rotary member when a power is supplied to an apparatus body or when an operation of the apparatus is restored after the operation is temporarily suspended.

* * * * *

UNITED STATES PATENT AND TRADEMARK OFFICE

CERTIFICATE OF CORRECTION

PATENT NO. : 6,496,661 B2
DATED : December 17, 2002
INVENTOR(S) : Masao Ando et al.

It is certified that error appears in the above-identified patent and that said Letters Patent is hereby corrected as shown below:

Column 8,
Line 14, "of" should be deleted.

Signed and Sealed this

First Day of July, 2003

JAMES E. ROGAN
*Director of the United States Patent and Trademark Office*